US011810520B2

(12) United States Patent
Li et al.

(10) Patent No.: US 11,810,520 B2
(45) Date of Patent: Nov. 7, 2023

(54) METHOD AND APPARATUS FOR COMPENSATING WHITE POINT COORDINATES, AND COMPUTER DEVICE AND STORAGE MEDIUM

(71) Applicants: Hefei BOE Optoelectronics Technology Co., Ltd., Anhui (CN); BOE Technology Group Co., Ltd., Beijing (CN)

(72) Inventors: Jingyong Li, Beijing (CN); Jun Hong, Beijing (CN); Lei Lv, Beijing (CN); Fei Xu, Beijing (CN); Yanbin Wang, Beijing (CN); Chunmin Xu, Beijing (CN); Wenhong Tian, Beijing (CN)

(73) Assignees: Hefei BOE Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/427,623

(22) PCT Filed: Dec. 30, 2020

(86) PCT No.: PCT/CN2020/141638
§ 371 (c)(1),
(2) Date: Jul. 30, 2021

(87) PCT Pub. No.: WO2021/196791
PCT Pub. Date: Oct. 7, 2021

(65) Prior Publication Data

US 2023/0162690 A1 May 25, 2023

(30) Foreign Application Priority Data

Mar. 30, 2020 (CN) ..... 202010235250.9

(51) Int. Cl.
*G09G 3/3283* (2016.01)
*G09G 3/36* (2006.01)

(52) U.S. Cl.
CPC ..... *G09G 3/3283* (2013.01); *G09G 3/3607* (2013.01); *G09G 2310/0237* (2013.01); *G09G 2320/0626* (2013.01); *G09G 2340/06* (2013.01)

(58) Field of Classification Search
CPC ..... G09G 3/3283; G09G 3/3607; G09G 2310/0237; G09G 2320/0242; G09G 2340/06
(Continued)

(56) References Cited

U.S. PATENT DOCUMENTS 7,679,783 B2 3/2010 Pellar
2008/0266316 A1 10/2008 Takahashi
(Continued)

FOREIGN PATENT DOCUMENTS

CN 101221734 A 7/2008
CN 102034407 A 4/2011
(Continued)

OTHER PUBLICATIONS

CN202010235250.9 first office action.
(Continued)

*Primary Examiner* — Jimmy H Nguyen
(74) *Attorney, Agent, or Firm* — IPro, PLLC

(57) ABSTRACT

The present disclosure belongs to the field of display technologies, and provides a method and apparatus for compensating white point coordinates, and a computer device and a storage medium. The method includes: acquiring target brightness and target white point coordinates of a display module in a black frame insertion mode, wherein the display module includes a backlight; determining white point coor-
(Continued)

dinates corresponding to the target brightness to be reached by the backlight in the black frame insertion mode and in an always-on mode, respectively; and compensating the target white point coordinates based on a difference value between the white point coordinates in the always-on mode and the white point coordinates in the black frame insertion mode.

20 Claims, 4 Drawing Sheets

(58) Field of Classification Search
USPC ..... 345/77, 83, 102
See application file for complete search history.

(56) References Cited

U.S. PATENT DOCUMENTS

| | | | | |
|---|---|---|---|---|
| 2008/0297456 | A1 | 12/2008 | Marcu et al. | |
| 2009/0128451 | A1* | 5/2009 | Tokui | G03B 21/2053 345/55 |
| 2014/0267785 | A1 | 9/2014 | Chen et al. | |
| 2018/0005560 | A1* | 1/2018 | Itakura | G09G 3/20 |
| 2018/0308452 | A1 | 10/2018 | Zhang | |
| 2021/0166606 | A1 | 6/2021 | Han et al. | |

FOREIGN PATENT DOCUMENTS

| | | | |
|---|---|---|---|
| CN | 102779498 | A | 11/2012 |
| CN | 104167174 | A | 11/2014 |
| CN | 105405398 | A | 3/2016 |
| CN | 105931613 | A | 9/2016 |
| CN | 107068114 | A | 8/2017 |
| CN | 106782347 | B | 12/2018 |
| CN | 109147702 | A | 1/2019 |
| CN | 109308861 | A | 2/2019 |
| CN | 109410839 | A | 3/2019 |
| CN | 110197642 | A | 9/2019 |
| CN | 111402817 | A | 7/2020 |
| JP | H08265667 | A | 10/1996 |
| JP | 2012220674 | A | 11/2012 |

OTHER PUBLICATIONS

CN202010235250.9 Notification to grant patent right for invention.
2 Stack-2&3 Color Top Emission White OLEDs for AR and VR.
Color temperature calibration of liquid crystal display of mobile phone.
Color Gamut Correction of LED Displays.
Regulated method of realizing white balance for LCD based on FPGA.
Model prediction on the correlated color temperature of white LED based on chromaticity coordinate.

* cited by examiner

METHOD AND APPARATUS FOR COMPENSATING WHITE POINT COORDINATES, AND COMPUTER DEVICE AND STORAGE MEDIUM

CROSS REFERENCE TO RELATED APPLICATION

This application is a 371 of PCT Patent Application Serial No. PCT/CN2020/141638, filed on Dec. 30, 2020, which claims priority to Chinese Patent Application No. 202010235250.9, filed on Mar. 30, 2020 and entitled "METHOD AND APPARATUS FOR COMPENSATING WHITE POINT COORDINATES, AND COMPUTER DEVICE AND STORAGE MEDIUM", the contents of which is herein incorporated by reference in its entirety.

TECHNICAL FIELD

The present disclosure relates to the field of display technologies, and in particular to a method and apparatus for compensating white point coordinates, and a computer device and a storage medium.

BACKGROUND

When a user wears a virtual reality (VR) device with liquid crystal display and shakes his head, a temporarily lingering phenomenon may occur on the picture that the user sees; when two pictures, that is, the temporarily lingering picture and the currently displayed picture, are reflected in the brain at the same time, smear may be produced, causing the user to feel dizzy.

In the related art, the above problem may be solved through a backlight black frame insertion technology. In the backlight black frame insertion technology, a picture display period corresponding to a picture of the VR device is divided into three parts: data scan time (ST), liquid crystal response time (RT) and backlight light-up time (BLUT). A backlight only needs to be turned on during the BLUT, and a normal picture is generated at this time; the backlight remains turned off at other times, and a black picture appears. The above temporarily lingering phenomenon is avoided by inserting a full black frame between the displayed normal pictures based on the above solution.

In a production process, a burning device calculates white point (that is, the whitest point in a display, for example, a point of which gray scales of red, green and blue are all 255) coordinates according to detected optical data, and burns the white point coordinates into an integrated circuit (IC) of the VR device. At present, the burning device is incapable of supporting calculation of the white point coordinates of the backlight in a black frame insertion mode, and can only support calculation of the white point coordinates of the backlight in an always-on mode and directly burn the white point coordinates calculated in the always-on mode into the IC of the VR device in the black frame insertion mode. When the IC of the VR device controls the backlight to operate based on the white point coordinates, the white point coordinates are inevitably unmatched with the displayed picture, resulting in color deviation of the displayed picture.

SUMMARY

Embodiments of the present disclosure provide a method and apparatus for compensating white point coordinates, and a computer deice and a storage medium, which may compensate the white point coordinates burned into the IC and enable the final white point coordinates of the VR device to be more accurate.

According to an aspect of embodiments of the present disclosure, a method for compensating white point coordinates is provided. The method includes:

acquiring target brightness and target white point coordinates of a display module in a black frame insertion mode, wherein the display module includes a backlight;

determining white point coordinates corresponding to the target brightness to be reached by the backlight in the black frame insertion mode and in an always-on mode, respectively; and compensating the target white point coordinates based on a difference value between the white point coordinates in the always-on mode and the white point coordinates in the black frame insertion mode.

Optionally, determining white point coordinates corresponding to the target brightness to be reached by the backlight in the black frame insertion mode and in the always-on mode respectively includes:

acquiring a first current required for the backlight to reach the target brightness in the always-on mode based on the target brightness and a function relationship between the current and the brightness of the backlight in the always-on mode;

acquiring a second current required for the backlight to reach the target brightness in the black frame insertion mode based on the first current; and acquiring the white point coordinates of the backlight in the always-on mode and the white point coordinates of the backlight in the black frame insertion mode respectively based on the first current, the second current and a function relationship between the white point coordinates and the current of the backlight in the always-on mode.

Optionally, acquiring the second current required for the backlight to reach the target brightness in the black frame insertion mode based on the first current includes:

acquiring the second current by multiplying a reciprocal of a product of a difference between 1 and a brightness loss coefficient and a duty ratio by the first current.

Optionally, the brightness loss coefficient is 10%.

Optionally, the method further includes:

acquiring brightness corresponding to different currents and white point coordinates corresponding to different currents of the backlight in the always-on mode;

acquiring the function relationship between the current and the brightness by performing fitting based on the brightness corresponding to different currents; and acquiring the function relationship between the white point coordinates and the current by performing fitting based on the white point coordinates corresponding to different currents.

Optionally, compensating the target white point coordinates with the difference value between the white point coordinates in the always-on mode and the white point coordinates in the black frame insertion mode includes:

acquiring the compensated target white point coordinates by adding the product of the difference value between the white point coordinates in the black frame insertion mode and the white point coordinates in the always-on mode and a compensation proportion coefficient to the target white point coordinates.

Optionally, the method further includes:

acquiring the detected white point coordinates of the display module when the display module displays in the black frame insertion mode, wherein the display module controls the backlight to operate based on the compensated target white point coordinates; and adjusting the compensation proportion coefficient based on the detected white point coordinates of the display module and the target white point coordinates when a difference value between coordinate values of the detected white point coordinates of the display module and the target white point coordinates on any coordinate axis is greater than a set value.

Optionally, the compensation proportion coefficient includes $K_1$ and $K_2$, the white point coordinates include two coordinate values X and Y, the compensation proportion coefficient corresponding to X is $K_1$, and the compensation proportion coefficient corresponding to Y is $K_2$.

Adjusting the compensation proportion coefficient based on the detected white point coordinates of the display module and the target white point coordinates includes:

when the detected white point coordinate X of the display module is greater than the target white point coordinate X, decreasing $K_1$; and when the detected white point coordinate X of the display module is smaller than the target white point coordinate X, increasing $K_1$; and when the detected white point coordinate Y of the display module is greater than the target white point coordinate Y, decreasing $K_2$; and when the detected white point coordinate Y of the display module is smaller than the target white point coordinate Y, increasing $K_2$.

Optionally, X is an abscissa of the white point coordinates, Y is an ordinate of the white point coordinates, the adjusted $K_1$ is 0.07, and the adjusted $K_2$ is 0.5.

Optionally, the method is applied to a liquid crystal display of a virtual reality device, and the liquid crystal display includes the display module.

According to an aspect of embodiments of the present disclosure, an apparatus for compensating white point coordinates is provided. The apparatus includes:

an acquiring module, configured to acquire target brightness and target white point coordinates of a display module in a black frame insertion mode, wherein the display module includes a backlight;

a determining module, configured to determine white point coordinates corresponding to the target brightness to be reached by the backlight in the black frame insertion mode and in an always-on mode, respectively; and an outputting module, configured to compensate the target white point coordinates based on a difference value between the white point coordinates in the always-on mode and the white point coordinates in the black frame insertion mode.

According to an aspect of embodiments of the present disclosure, a computer device is provided. The computer device includes a processor and a memory;

the memory is configured to store computer programs;

the processor is configured to execute the computer programs stored in the memory, so as to implement the method for compensating white point coordinates according to any of the above aspects.

According to an aspect of embodiments of the present disclosure, a computer readable storage medium is provided. The computer readable storage medium stores computer instructions, and the stored computer instructions, when executed by a processor, are capable of implementing the method for compensating white point coordinates according to any of the above aspects.

In the technical solution, the target brightness and the target white point coordinates to be reached by the display module in the black frame insertion mode are acquired, and the white point coordinates of the backlight in the display module in the always-on mode and the black frame insertion mode are determined respectively based on the target brightness; then, the difference value of the white point coordinates in the always-on mode and the black frame insertion mode may be acquired based on the white point coordinates of the backlight in the display module in these two modes, and the target white point coordinates to be reached by the display module in the black frame insertion mode are compensated based on the difference value to acquire the white point coordinates in the always-on mode corresponding to the target white point coordinates, that is, the white point coordinates that may be finally burnt into the IC; in this solution, by compensating the white point coordinates, the white point coordinates burnt into the IC satisfy requirements of the VR device in the black frame insertion mode better, and are matched with the displayed picture better, thereby reducing the color deviation of the displayed picture.

BRIEF DESCRIPTION OF THE DRAWINGS

For clearer descriptions of the technical solutions in the embodiments of the present disclosure, the following briefly introduces accompanying drawings required for describing the embodiments. Apparently, the accompanying drawings in the following description show merely some embodiments of the present disclosure, and persons of ordinary skill in the art may still derive other drawings from these accompanying drawings without creative efforts.

DETAILED DESCRIPTION

For clearer descriptions of the objectives, technical solutions, and advantages of the present disclosure, embodiments of the present disclosure are described in detail hereinafter with reference to the accompanying drawings.

Figure 1:
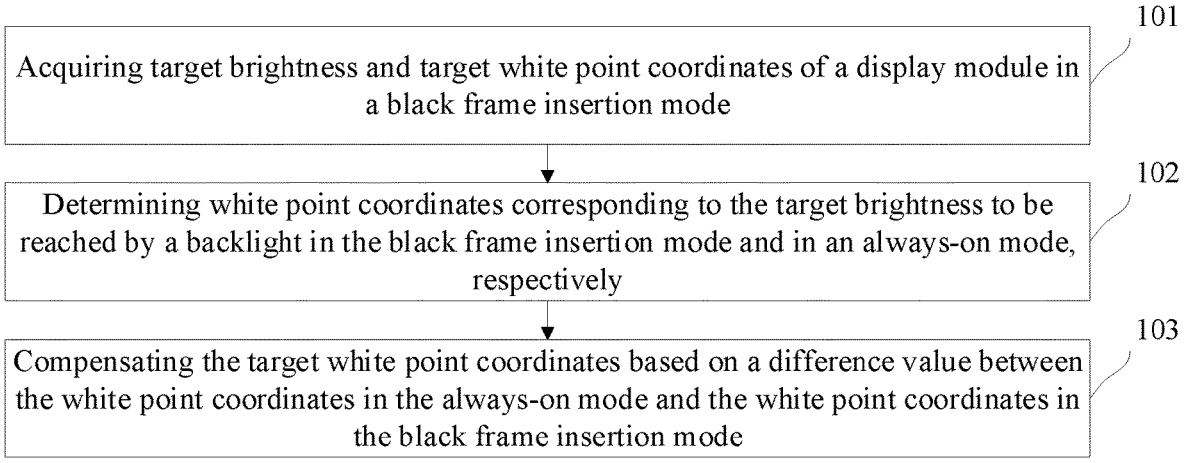
FIG. 1 is a flowchart of a method for compensating white point coordinates according to an embodiment of the present disclosure.

FIG. 1 is a flowchart of a method for compensating white point coordinates according to an embodiment of the present disclosure. As shown in FIG. 1, the method includes the following steps.

In 101, target brightness and target white point coordinates of a display module in a black frame insertion mode are acquired, wherein the display module includes a backlight.

In the display module, the backlight and a display panel are assembled together to form the display module.

Chromaticity coordinates are coordinates of a color, and common chromaticity coordinates include an abscissa x and an ordinate y. The whitest point in a display refers to a white point when the display displays white of 255, 255, 255, and coordinates of white of 255, 255, 255 in the chromaticity coordinates are referred to as white point coordinates.

During gamma burning, the white point coordinates and gamma data are burnt together into an integrated circuit (IC) of the display module. Therefore, whether the white point coordinates are appropriate is related to the subsequent color deviation displayed by the display module.

The white point coordinates burnt into the IC should make the detected white point coordinates when the display module emits light satisfy requirements.

In embodiments of the present disclosure, a light emitting mode of the backlight in the display module is divided into an always-on mode and a black frame insertion mode. The always-on mode refers to a mode in which the backlight always emits light; the black frame insertion mode refers to a mode in which the backlight is periodically turned on and off. For example, a frame of picture displayed by the display module corresponds to a display period, and the display period is divided into three parts: data scan time (ST), liquid crystal response time (RT) and backlight light-up time (BLUT). The backlight is only required to open at the BLUT. In the always-on mode, the backlight is controlled by a direct current (DC); in the black frame insertion mode, the backlight is controlled by a pulse width modulation (PWM) current. Since the white point coordinates are correlated to the current, a difference of currents in different modes may result in a difference of white point coordinates.

In actual production, a burning device for burning gamma and white point coordinates may be only operated in the always-on mode. However, for a VR device, the display module is in the black frame insertion mode. Therefore, the white point coordinates directly acquired by the burning device are incapable of satisfying the requirements of the display module of the VR device, and are to be compensated.

In 102, the white point coordinates corresponding to the target brightness to be reached by the backlight in the black frame insertion mode and in the always-on mode are determined, respectively.

In 103, the target white point coordinates are compensated based on a difference value between the white point coordinates in the always-on mode and the white point coordinates in the black frame insertion mode.

In this solution, the target brightness and the target white point coordinates to be reached by the display module in the black frame insertion mode are acquired, and the white point coordinates of the backlight in the display module in the always-on mode and the black frame insertion mode are determined respectively based on the target brightness; then, the difference value of the white point coordinates in the always-on mode and the black frame insertion mode may be acquired based on the white point coordinates of the backlight in the display module in these two modes, and the target white point coordinates to be reached by the display module in the black frame insertion mode are compensated based on the difference value to acquire the white point coordinates in the always-on mode corresponding to the target white point coordinates, that is, the white point coordinates that may be finally burnt into the IC; in this solution, by compensating the white point coordinates, the white point coordinates burnt into the IC satisfy requirements of the VR device in the black frame insertion mode better, and are matched with the displayed picture better, thereby reducing the color deviation of the displayed picture.

Figure 2:
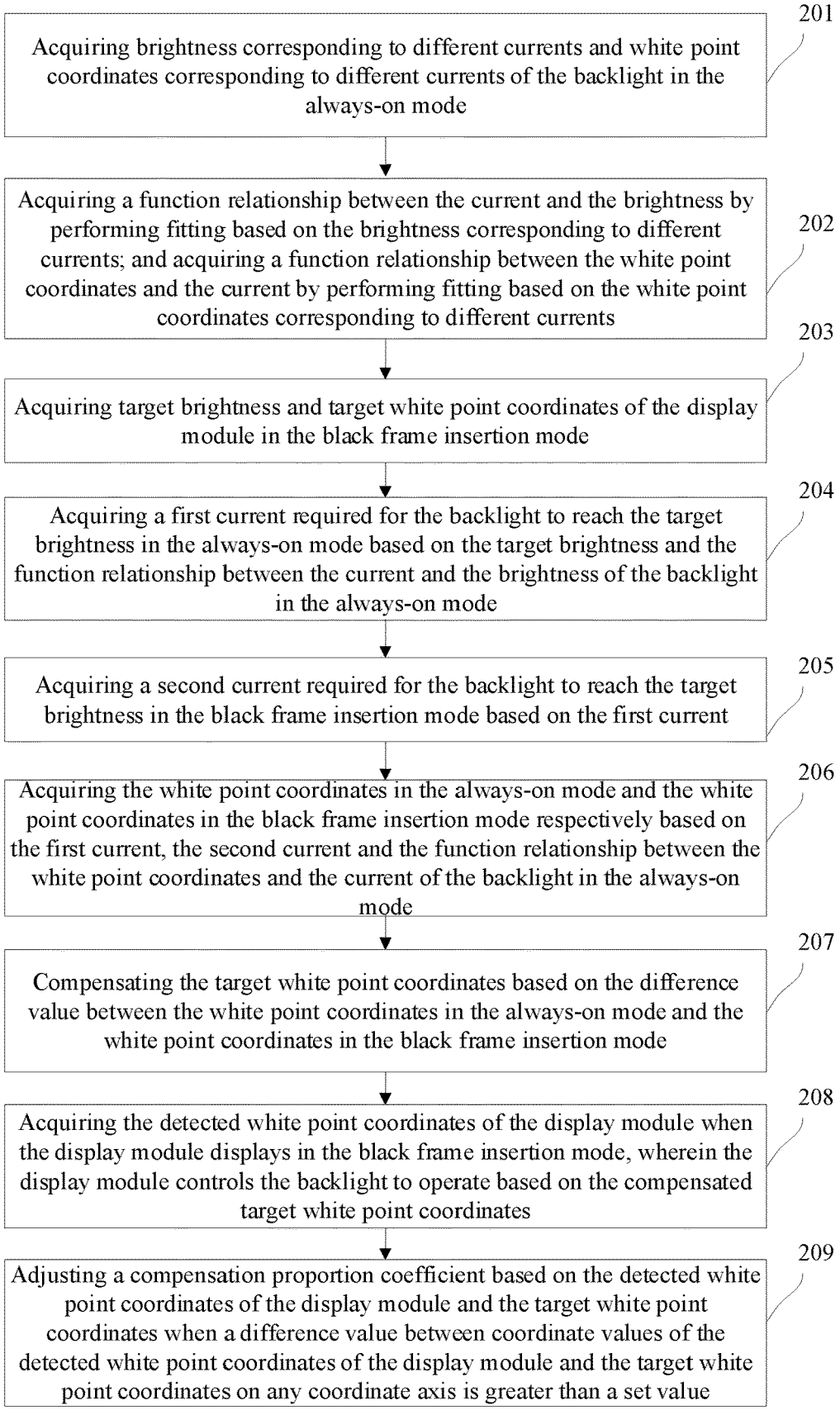
FIG. 2 is a flowchart of a method for compensating white point coordinates according to an embodiment of the present disclosure.

FIG. 2 is a flowchart of a method for compensating white point coordinates according to an embodiment of the present disclosure. The method is applied to a liquid crystal display device using backlight black frame insertion technology, for example, a liquid crystal display device of a virtual reality device, and the liquid crystal display includes a display module. The method may be performed by a burning device, or performed by a computer device connected with a burning device. As shown in FIG. 2, the method includes the following steps.

In 201, brightness corresponding to different currents and white point coordinates corresponding to different currents of the backlight in the always-on mode are acquired.

As described above, in the actual production, the burning device (Auto gamma) for burning gamma and white point coordinates may be only operated in the always-on mode, so that parameters of brightness and white point coordinates of the backlight in the always-on mode may be only acquired. The backlight is controlled to be at different currents to acquire the corresponding brightness and the corresponding white point coordinates, respectively.

In an exemplary embodiment, the corresponding brightness and the corresponding white point coordinates of the backlight at different currents may be acquired by detection of a color analyzer.

Table 1 shows test results of brightness and chromaticity coordinates at different currents.

TABLE 1

| Current I(mA) | Brightness LV(nit) | X(CIE) | Y(CIE) |
|---|---|---|---|
| $I_1$ | $LV_1$ | $X_1$ | $Y_1$ |
| . . . | . . . | . . . | . . . |
| $I_n$ | $LV_n$ | $X_n$ | $Y_n$ |

It is to be noted that the brightness and the white point coordinates of a single backlight are acquired in 201 before the display module is assembled.

In 202, a function relationship between the current and the brightness is acquired by performing fitting based on the brightness corresponding to different currents; a function relationship between the white point coordinates and the current is acquired by performing fitting based on the white point coordinates corresponding to different currents.

In embodiments of the present disclosure, the function relationship between the current and the brightness and the function relationship between the white point coordinates and the current are acquired by fitting the brightness and white point coordinate corresponding to different currents of the backlight in the always-on mode, thereby reflecting relationships among the current, the brightness and the white point coordinates in the backlight better. The function relationship between the current and the brightness and the function relationship between the white point coordinates and the current of the single backlight are acquired by performing fitting before the display module is assembled. The current of the backlight refers to an operation current driving the backlight to emit light.

In an exemplary embodiment, the following function relationship formulas (1) and (2) are acquired by fitting the data acquired in 201 based on a polynomial fitting scheme.

$$I=F_1^{-1}(LV) \tag{1}$$

$$x=F_2(I), y=F_3(I) \tag{2}$$

In the above formulas, $F_1^{-1}$ refers to inverse function, $F_2$ and $F_3$ refer to function, I refers to the current of the backlight, LV refers to the brightness of the backlight, and (x,y) refers to the white point coordinates of the backlight.

In 203, the target brightness and the target white point coordinates of the display module in the black frame insertion mode are acquired.

The target brightness and the target white point coordinates of the display module in the black frame insertion mode are provided by a client herein. The object of the present disclosure is to ensure that the finally compensated white point coordinates burnt into the IC of the display module can control the white point coordinates when the display module displays the picture in the black frame insertion mode to be the target white point coordinates described above.

It is to be noted that the target brightness and the target white point coordinates are acquired in 203 after the display module is assembled, and the display module is formed by assembling the backlight and the display panel.

In 204, a first current required for the backlight to reach the target brightness in the always-on mode is acquired based on the target brightness and the function relationship between the current and the brightness of the backlight in the always-on mode.

In an exemplary embodiment, the first current is calculated based on the following formula (3).

$$I_{DC}=F_1^{-1}(LV_i) \tag{3}$$

In the above formula, $I_{DC}$ refers to the first current, and $LV_i$ refers to the target brightness.

In 205, a second current required for the backlight to reach the target brightness in the black frame insertion mode is acquired based on the first current.

Optionally, acquiring the second current required by the backlight in the black frame insertion mode based on the first current includes:

acquiring the second current by multiplying a reciprocal of a product of a difference between 1 and a brightness loss coefficient and a duty ratio by the first current.

In an exemplary embodiment, the second current is calculated based on the following formula (4).

$$I_{PWM}=\frac{(F_1^{-1}LV_i)}{(1-K_3)\times \text{Duty}} \tag{4}$$

In the above formula, $I_{PWM}$ refers to the second current, Duty refers to the duty ratio in the black frame insertion mode, and $K_3$ refers to the brightness loss coefficient.

The duty ratio in the black frame insertion mode is also a specific value of the backlight turn-on time and backlight turn-off time (data scan time and liquid crystal response time), for example, 10%. The brightness loss coefficient refers to that since the backlight turn-on time is short in the black frame insertion mode, increase and decrease of the PWM current may take up some time, resulting in loss of the actual brightness compared with that in an ideal state. In the present disclosure, this part of loss is indicated by the brightness loss coefficient.

In an exemplary embodiment, the brightness loss coefficient may be acquired by detection. For example, the brightness loss coefficient may be 10%.

In 206, the white point coordinates of the backlight in the always-on mode and the white point coordinates of the backlight in the black frame insertion mode are acquired respectively based on the first current, the second current and the function relationship between the white point coordinates and the current of the backlight in the always-on mode.

The white point coordinates in the always-on mode are calculated based on the following formula (5).

$$X_a=F_2(I_{DC}),Y_a=F_3(I_{DC}) \tag{5}$$

The white point coordinates in the black frame insertion mode are calculated based on the following formula (6).

$$X_b=F_2(I_{PWM}),Y_b=F_3(I_{PWM}) \tag{6}$$

In the above formulas, $(X_a, Y_a)$ refers to the white point coordinates in the always-on mode, and $(X_b, Y_b)$ refers to the white point coordinates in the black frame insertion mode.

In 207, the target white point coordinates are compensated based on the difference value between the white point coordinates in the always-on mode and the white point coordinates in the black frame insertion mode.

Optionally, compensating the target white point coordinates based on the difference value between the white point coordinates in the always-on mode and the white point coordinates in the black frame insertion mode includes:

acquiring the compensated target white point coordinates by adding the product of the difference value between the white point coordinates in the black frame insertion mode and the white point coordinates in the always-on mode and the compensation proportion coefficient to the target white point coordinates.

In an exemplary embodiment, the compensated target white point coordinates are calculated based on the following formulas (7) and (8).

$$X_o=X_i+K_1\left(F_2\left(\frac{(F_1^{-1}LV_i)}{(1-K_3)\times \text{Duty}}\right)-F_2(F_1^{-1}(LV_i))\right) \tag{7}$$

$$Y_O=Y_i+K_2\left(F_3\left(\frac{(F_1^{-1}LV_i)}{(1-K_3)\times \text{Duty}}\right)-F_3(F_1^{-1}(LV_i))\right) \tag{8}$$

In the above formulas, $(X_o, Y_o)$ refers to the compensated target white point coordinates, and $(X_i, Y_i)$ refers to the target white point coordinates. $K_1$ and $K_2$ are compensation proportion coefficients, the white point coordinates include two coordinate values X and Y, the compensation proportion coefficient corresponding to X is $K_1$, and the compensation proportion coefficient corresponding to Y is $K_2$.

After the compensated white point coordinates are acquired in 207, gamma burning may be performed for the compensated target white point coordinates.

Descriptions are made to steps 201 to 207 below in combination with embodiments.

For example, the function relationship acquired by fitting is as follows:

$$I=F_1^{-1}(LV)=5\times10^{-4}LV+3.4301;$$

$$x=F_2(I)=-1\times10^{-4}/+0.3044;$$

$$y=F_3(I)=-2\times10^{-4}LV+0.2765.$$

The target white point coordinates provided by the user are $(x_i,y_i)=(0.28,0.29)$, and the target brightness provided by the user is $LV_i=7268$.

The current required by the backlight in the always-on mode is calculated as $I_{DC}=8.1126$ mA.

The current required by the backlight in the black frame insertion mode is calculated as $I_{PWM}=90.1405$ mA.

The white point coordinates in the always-on mode calculated based on $I_{DC}$ are $(X_a, Y_a)=(0.3036,0.2745)$.

The white point coordinates in the black frame insertion mode calculated based on $I_{pwm}$ are $(X_b, Y_b)=(0.2892, 0.2537)$.

The compensated white point coordinates are calculated as $(X_O, Y_O)=(0.2810,0.3004)$.

After the results are burnt to the display module, it may be ensured that the white point coordinates generated by the display module are in a satisfactory range, thereby indicating feasibility of the method.

In 208, the detected white point coordinates of the display module when the display module displays in the black frame insertion mode are acquired, wherein the display module controls the backlight to operate based on the compensated target white point coordinates.

After the compensated white point coordinates are burnt into the IC, the display module is generated through a process such as module encapsulation. After the generation of the display module is completed, whether the compensated target white point coordinates in 207 are to be further adjusted may be verified by detecting the white point coordinates of the display module.

If it is determined that the compensated target white point coordinates are not to be adjusted, the compensated target white point coordinates described above are continued to be used in the subsequent production; if it is determined that the compensated target white point coordinates are to be adjusted, the compensated target white point coordinates are adjusted during the subsequent production, and steps 208 and 209 are repeated until the adjustment is finally unneeded.

In an exemplary embodiment, whether the compensated target white point coordinates satisfy the requirements is verified by re-lighting in the black frame insertion mode. Since the display module is already produced herein, the white point coordinates may be verified in the black frame insertion mode at this time.

In 209, when a difference value between coordinate values of the detected white point coordinates of the display module and the target white point coordinates on any coordinate axis is greater than a set value, the compensation proportion coefficient is adjusted based on the detected white point coordinates of the display module and the target white point coordinates.

In embodiments of the present disclosure, $K_1$ and $K_2$ are empirical values to be adjusted in 208 and 209, thereby ensuring an accuracy of the finally compensated target white point coordinates.

Step 209 may include: decreasing $K_1$ when the detected white point coordinate X of the display module is greater than the target white point coordinate X; and increasing $K_1$ when the detected white point coordinate X is smaller than the target white point coordinate X; and decreasing $K_2$ when the detected white point coordinate Y of the display module is greater than the target white point coordinate Y; and increasing $K_2$ when the detected white point coordinate Y is smaller than the target white point coordinate Y.

In embodiments of the present disclosure, a feedback is formed based on the detection result when the display module displays in the black frame insertion mode, thereby optimizing $K_1$ and $K_2$ and enabling the white point coordinates subsequently burnt into a same type of other display modules to be the most accurate.

Optionally, X is an abscissa of the white point coordinates, Y is an ordinate of the white point coordinates, the adjusted $K_1$ may be 0.07, and the adjusted $K_2$ may be 0.5. The use of the compensation proportion coefficient may ensure a good displaying effect of the liquid crystal display device.

After the compensation proportion coefficient is adjusted, the compensated target white point coordinates may be adjusted by using the adjusted compensation proportion coefficient, and then taken as the white point coordinates to be burnt into the IC. It is to be noted that the display module for burning in 207 and the display module for burning in 209 are not the same liquid crystal display device. Steps 201 to 209 may be performed before batch production. Steps 201 to 207 belong to a design stage before batch production, and steps 208 and 209 belong to a debugging stage during batch production. After the white point coordinates are determined in 209, the batch production of liquid crystal display devices (e.g., VR devices) may be carried out based on the white point coordinates.

Figure 3:
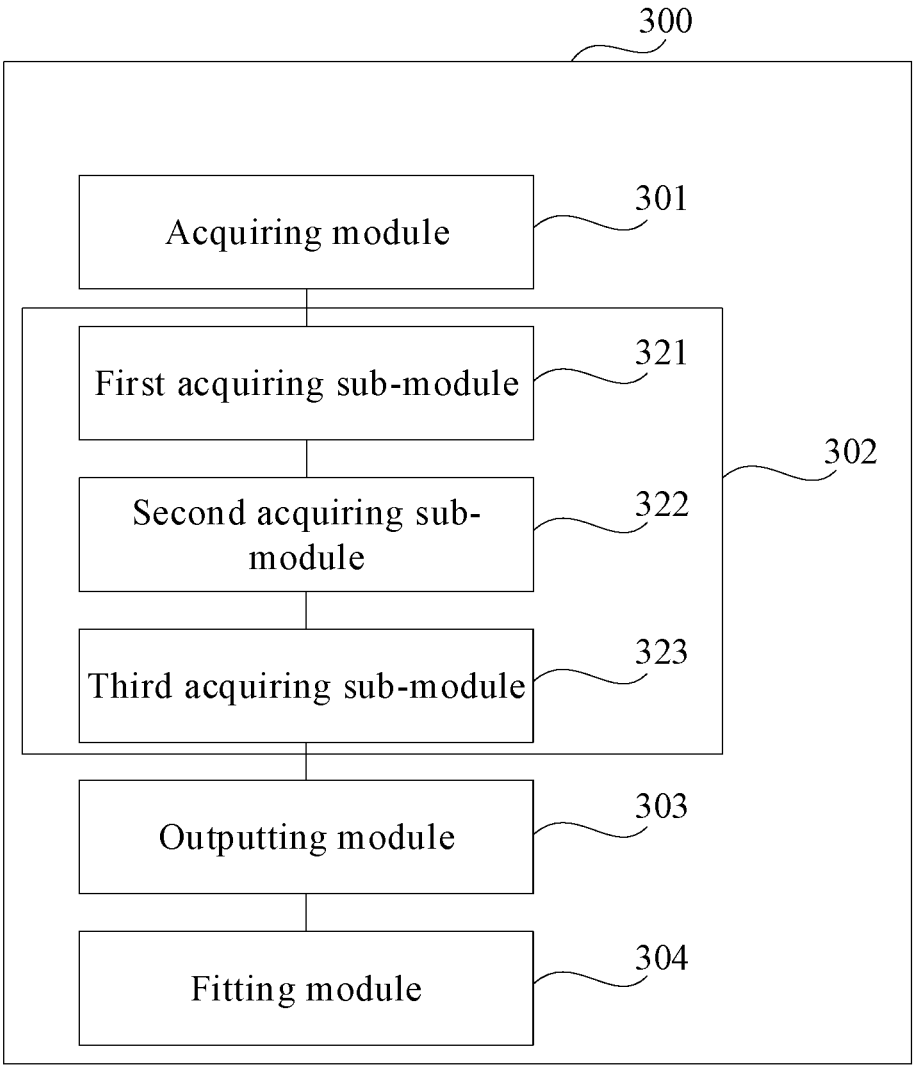
FIG. 3 is a block diagram of an apparatus for compensating white point coordinates according to an embodiment of the present disclosure.

FIG. 3 is a block diagram of an apparatus 300 for compensating white point coordinates according to an embodiment of the present disclosure. As shown in FIG. 3, the apparatus 300 for compensating white point coordinates includes: an acquiring module 301, a determining module 302 and an inputting module 303.

The acquiring module 301 is configured to acquire target brightness and target white point coordinates of a display module in a black frame insertion mode, wherein the display module includes a backlight.

The determining module 302 is configured to determine white point coordinates corresponding to the target brightness to be reached by the backlight in the black frame insertion mode and in an always-on mode, respectively.

The outputting module 303 is configured to compensate the target white point coordinates based on a difference value between the white point coordinates in the always-on mode and the white point coordinates in the black frame insertion mode.

Optionally, the determining module 302 includes:

a first acquiring sub-module 321, configured to acquire a first current required for the backlight to reach the target brightness in the always-on mode based on the target brightness and a function relationship between the current and the brightness of the backlight in the always-on mode;

a second acquiring sub-module 322, configured to acquire a second current required for the backlight to reach the target brightness in the black frame insertion mode based on the first current; and a third acquiring sub-module 323, configured to acquire the white point coordinates of the backlight in the always-on mode and the white point coordinates of the backlight in the black frame insertion mode respectively based on the first current, the second current and a function relationship between the white point coordinates and the current of the backlight in the always-on mode.

Optionally, the second acquiring sub-module 322 is configured to acquire the second current by multiplying a reciprocal of a product of a difference between 1 and a brightness loss coefficient and a duty ratio by the first current.

Optionally, the brightness loss coefficient is 10%.

Optionally, the acquiring module 301 is further configured to acquire brightness corresponding to different currents and white point coordinates corresponding to different currents of the backlight in the always-on mode.

The apparatus further includes: a fitting module 304, configured to acquire a function relationship between the current and the brightness by performing fitting based on the brightness corresponding to different currents; and acquire a function relationship between the white point coordinates and the current by performing fitting based on the white point coordinates corresponding to different currents.

Optionally, the outputting module 303 is configured to acquire the compensated target white point coordinates by adding the product of the difference value between the white point coordinates in the black frame insertion mode and the white point coordinates in the always-on mode and a compensation proportion coefficient to the target white point coordinates.

Optionally, the acquiring module 301 is further configured to acquire the detected white point coordinates of the display module when the display module displays in the black frame insertion mode, wherein the display module controls the backlight to operate based on the compensated target white point coordinates.

The outputting module 303 is further configured to adjust the compensation proportion coefficient based on the detected white point coordinates of the display module and the target white point coordinates when a difference value between coordinate values of the detected white point coordinates of the display module and the target white point coordinates on any coordinate axis is greater than a set value.

Optionally, the compensation proportion coefficient includes $K_1$ and $K_2$, the white point coordinates include two coordinate values X and Y, the compensation proportion coefficient corresponding to X is $K_1$, and the compensation proportion coefficient corresponding to Y is $K_2$.

The outputting module 303 is configured to decrease $K_1$ when the detected white point coordinate X of the display module is greater than the target white point coordinate X; and increase $K_1$ when the detected white point coordinate X of the display module is smaller than the target white point coordinate X.

The outputting module 303 is further configured to decrease $K_2$ when the detected white point coordinate Y of the display module is greater than the target white point coordinate Y; and increase $K_2$ when the detected white point coordinate Y of the display module is smaller than the target white point coordinate Y.

Optionally, X is an abscissa of the white point coordinate, Y is an ordinate of the white point coordinate, the adjusted $K_1$ is 0.07, and the adjusted $K_2$ is 0.5.

Optionally, the device is applied to a liquid crystal display of a virtual reality (VR) device, and the liquid crystal display includes a display module. The VR device may be a VR device of a head-mounted mobile terminal that may be used with cooperation of a mobile terminal, for example, a mobile phone; the VR device may also be a VR device of a head-mounted host computer that may be used with cooperation of a host computer; the VR device may also be a VR device of a head-mounted computer that may be used with cooperation of a computer; the VR device may also be a VR device of a useable head-mounted all-in-one machine.

It is to be noted that division of all of the above functional modules is described only as an example when the apparatus for compensating white point coordinates according to the above embodiment compensates the white point coordinates. In practice, the above functions may be completed by different functional modules as required. That is, an internal structure of the apparatus may be divided into different functional modules to complete all or part of the functions described above. In addition, the apparatus for compensating white point coordinates according to the above embodiment is based on the same inventive concept as the method embodiments for compensating white point coordinates, and for specific practice thereof, reference may be made to the method embodiments, which is not described any further herein.

Figure 4:
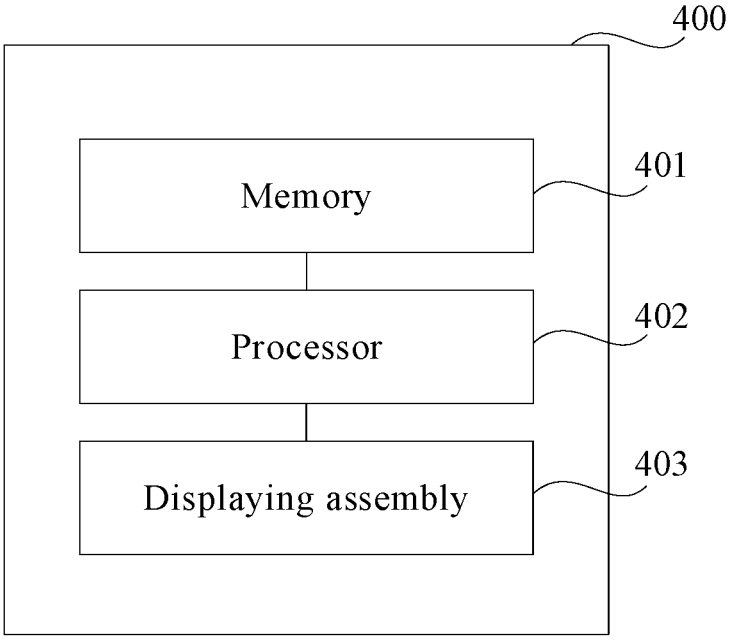
FIG. 4 is a structural schematic diagram of a computer device according to an embodiment of the present disclosure.

As shown in FIG. 4, an embodiment of the present disclosure further provides a computer device 400, and the computer device 400 may be a burning device, or a computer device connected with a burning device. The computer device 400 may be configured to perform the method for compensating white point coordinates according to each of the above embodiments. As shown in FIG. 4, the computer device 400 includes a memory 401, a processor 402 and a display assembly 403. Persons skilled in the art may understand that a structure of the computer device 400 shown in FIG. 4 does not constitute a limitation to the computer device 400. In practice, more or less components than those shown in the drawing, or a combination of some components, or different arrangements of components may be included.

The memory 401 may be configured to store computer programs and modules, and may mainly include a program storage zone and a data storage zone. The program storage zone may store an operating system, application programs required for at least one function, and the like. The memory 401 may include a high-speed random-access memory, and may further include a non-volatile memory, such as at least one magnetic disk storage device, a flash memory device, or other volatile solid-state storage devices. Correspondingly, the memory 401 may further include a memory controller to provide access of the processor 402 to the memory 401.

The processor 402 performs different functional applications and data processing based on software programs and modules operated and stored in the memory 401.

The display assembly 403 is configured to display an image, and may include a display panel. Optionally, the display panel may be configured in a form such as a liquid crystal display (LCD) and an organic light-emitting diode (OLED).

An embodiment of the present disclosure further provides a computer readable storage medium. The computer readable storage medium is a non-volatile storage medium, and stores computer programs. The computer programs stored in the computer readable storage medium, when executed by a processor, may perform the method for compensating white point coordinates according to an embodiment of the present disclosure.

An embodiment of the present disclosure further provides a computer program product storing instructions. The instructions, when run on a computer, cause the computer to perform the method for compensating white point coordinates according to an embodiment of the present disclosure.

An embodiment of the present disclosure further provides a chip, and the chip includes a programmable logic circuit and/or program instructions. During operation, the chip may perform the method for compensating white point coordinates according to an embodiment of the present disclosure.

Persons of ordinary skill in the art may understand that all or part of steps for implementing the above embodiments may be completed by hardware, or may also be completed by instructing relevant hardware through programs. The programs may be stored in a computer readable storage medium, and the storage medium mentioned above may be a read-only memory, a magnetic disk or a compact disk, or the like.

Described above are merely optional embodiments of the present disclosure, and are not intended to limit the present disclosure. Within the spirit and principles of the present disclosure, any modifications, equivalent substitutions, improvements, and the like are all within the scope of protection of the present disclosure.

What is claimed is:

1. A method for compensating white point coordinates, comprising:

acquiring target brightness and target white point coordinates of a display module in a black frame insertion mode, wherein the display module comprises a backlight;

determining white point coordinates corresponding to the target brightness to be reached by the backlight in the black frame insertion mode and in an always-on mode, respectively; and compensating the target white point coordinates based on a difference value between the white point coordinates in the always-on mode and the white point coordinates in the black frame insertion model;

wherein the compensating the target white point coordinates based on the difference value between the white point coordinates in the always-on mode and the white point coordinates in the black frame insertion mode comprises:

acquiring the compensated target white point coordinates by adding a product of a difference value between the white point coordinates in the black frame insertion mode and the white point coordinates in the always-on mode and a compensation proportion coefficient to the target white point coordinates.

2. The method according to claim 1, wherein the determining white point coordinates corresponding to the target brightness to be reached by the backlight in the black frame insertion mode and in the always-on mode respectively comprises:

acquiring a first current required for the backlight to reach the target brightness in the always-on mode based on the target brightness and a function relationship between a current and brightness of the backlight in the always-on mode;

acquiring a second current required for the backlight to reach the target brightness in the black frame insertion mode based on the first current; and acquiring the white point coordinates of the backlight in the always-on mode and the white point coordinates of the backlight in the black frame insertion mode respectively based on the first current, the second current and a function relationship between the white point coordinates and the current of the backlight in the always-on mode.

3. The method according to claim 2, wherein the acquiring the second current required for the backlight to reach the target brightness in the black frame insertion mode based on the first current comprises:

acquiring the second current by multiplying a reciprocal of a product of a difference between 1 and a brightness loss coefficient and a duty ratio by the first current.

4. The method according to claim 3, wherein the brightness loss coefficient is 10%.

5. The method according to claim 2, further comprising:

acquiring brightness corresponding to different currents and white point coordinates corresponding to different currents of the backlight in the always-on mode;

acquiring the function relationship between the current and the brightness by performing fitting based on the brightness corresponding to different currents; and acquiring the function relationship between the white point coordinates and the current by performing fitting based on the white point coordinates corresponding to different currents.

6. The method according to claim 1, further comprising:

acquiring detected white point coordinates of the display module when the display module displays in the black frame insertion mode, wherein the display module controls the backlight to operate based on the compensated target white point coordinates; and adjusting the compensation proportion coefficient based on the detected white point coordinates of the display module and the target white point coordinates when a difference value between coordinate values of the detected white point coordinates of the display module and the target white point coordinates on any coordinate axis is greater than a set value.

7. The method according to claim 6, wherein the compensation proportion coefficient comprises $K_1$ and $K_2$, the white point coordinates comprise two coordinate values X and Y, a compensation proportion coefficient corresponding to X is $K_1$, and a compensation proportion coefficient corresponding to Y is $K_2$, and both $K_1$ and $K_2$ are positive numbers; and the adjusting the compensation proportion coefficient based on the detected white point coordinates of the display module and the target white point coordinates comprises:

when a detected white point coordinate X of the display module is greater than a target white point coordinate X, decreasing $K_1$; and when the detected white point coordinate X of the display module is smaller than the target white point coordinate X, increasing $K_1$; and when a detected white point coordinate Y of the display module is greater than a target white point coordinate Y, decreasing $K_2$; and when the detected white point coordinate Y of the display module is smaller than the target white point coordinate Y, increasing $K_2$.

8. The method according to claim 7, wherein X is an abscissa of the white point coordinates, Y is an ordinate of the white point coordinates, the adjusted $K_1$ is 0.07, and the adjusted $K_2$ is 0.5.

9. The method according to claim 1, wherein the method is applied to a liquid crystal display of a virtual reality device, and the liquid crystal display comprises the display module.

10. A non-transitory computer readable storage medium, storing instructions therein, wherein the instructions, when executed by a processor, cause the processor performing the method for compensating white point coordinates according to claim 1.

11. The storage medium according to claim 10, wherein the determining white point coordinates corresponding to the target brightness to be reached by the backlight in the black frame insertion mode and in the always-on mode respectively comprises:

acquiring a first current required for the backlight to reach the target brightness in the always-on mode based on the target brightness and a function relationship between a current and brightness of the backlight in the always-on mode;

acquiring a second current required for the backlight to reach the target brightness in the black frame insertion mode based on the first current; and acquiring the white point coordinates of the backlight in the always-on mode and the white point coordinates of the backlight in the black frame insertion mode respectively based on the first current, the second current and a function relationship between the white point coordinates and the current of the backlight in the always-on mode.

12. A computer device, comprising a processor and a memory, wherein the memory is configured to store instructions, the instructions, when executed by the processor, cause the processor performing a method for compensating white point coordinates, and the method comprises:

acquiring target brightness and target white point coordinates of a display module in a black frame insertion mode, wherein the display module comprises a backlight;

determining white point coordinates corresponding to the target brightness to be reached by the backlight in the black frame insertion mode and in an always-on mode, respectively; and compensating the target white point coordinates based on a difference value between the white point coordinates in the always-on mode and the white point coordinates in the black frame insertion mode;

wherein the compensating the target white point coordinates based on the difference value between the white point coordinates in the always-on mode and the white point coordinates in the black frame insertion mode comprises:

acquiring the compensated target white point coordinates by adding a product of a difference value between the white point coordinates in the black frame insertion mode and the white point coordinates in the always-on mode and a compensation proportion coefficient to the target white point coordinates.

13. The computer device according to claim 12, wherein the determining white point coordinates corresponding to the target brightness to be reached by the backlight in the black frame insertion mode and in the always-on mode respectively comprises:

acquiring a first current required for the backlight to reach the target brightness in the always-on mode based on the target brightness and a function relationship between a current and brightness of the backlight in the always-on mode;

acquiring a second current required for the backlight to reach the target brightness in the black frame insertion mode based on the first current; and acquiring the white point coordinates of the backlight in the always-on mode and the white point coordinates of the backlight in the black frame insertion mode respectively based on the first current, the second current and a function relationship between the white point coordinates and the current of the backlight in the always-on mode.

14. The computer device according to claim 13, wherein the acquiring the second current required for the backlight to reach the target brightness in the black frame insertion mode based on the first current comprises:

acquiring the second current by multiplying a reciprocal of a product of a difference between 1 and a brightness loss coefficient and a duty ratio by the first current.

15. The computer device according to claim 14, wherein the brightness loss coefficient is 10%.

16. The computer device according to claim 13, wherein the method further comprises:

acquiring brightness corresponding to different currents and white point coordinates corresponding to different currents of the backlight in the always-on mode;

acquiring the function relationship between the current and the brightness by performing fitting based on the brightness corresponding to different currents; and acquiring the function relationship between the white point coordinates and the current by performing fitting based on the white point coordinates corresponding to different currents.

17. The computer device according to claim 12, wherein the method further comprises:

acquiring detected white point coordinates of the display module when the display module displays in the black frame insertion mode, wherein the display module controls the backlight to operate based on the compensated target white point coordinates; and adjusting the compensation proportion coefficient based on the detected white point coordinates of the display module and the target white point coordinates when a difference value between coordinate values of the detected white point coordinates of the display module and the target white point coordinates on any coordinate axis is greater than a set value.

18. The computer device according to claim 17, wherein the compensation proportion coefficient comprises $K_1$ and $K_2$, the white point coordinates comprise two coordinate values X and Y, a compensation proportion coefficient corresponding to X is $K_1$, and a compensation proportion coefficient corresponding to Y is $K_2$, and both $K_1$ and $K_2$ are positive numbers; and the adjusting the compensation proportion coefficient based on the detected white point coordinates of the display module and the target white point coordinates comprises:

when a detected white point coordinate X of the display module is greater than a target white point coordinate X, decreasing $K_1$; and when the detected white point coordinate X of the display module is smaller than the target white point coordinate X, increasing $K_1$; and when a detected white point coordinate Y of the display module is greater than a target white point coordinate Y, decreasing $K_2$; and when the detected white point coordinate Y of the display module is smaller than the target white point coordinate Y, increasing $K_2$.

19. The computer device according to claim 18, wherein X is an abscissa of the white point coordinates, Y is an ordinate of the white point coordinates, the adjusted $K_1$ is 0.07, and the adjusted $K_2$ is 0.5.

20. The computer device according to claim 12, wherein the computer device is a liquid crystal display of a virtual reality device, and the liquid crystal display comprises the display module.

* * * * *